US009136637B2

(12) United States Patent
Genta et al.

(10) Patent No.: US 9,136,637 B2
(45) Date of Patent: Sep. 15, 2015

(54) ELECTRICAL CONNECTOR COMPRISING A SEALING ELEMENT AND ASSEMBLY PROCESS

(71) Applicant: Tyco Electronics AMP Italia S.R.L., Collegno Torino (IT)

(72) Inventors: Alessandro Genta, Turin (IT); Raoul Zannini, Pianezza (IT)

(73) Assignee: Tyco Electronics AMP Italia S.R.L., Collegno Torino (IT)

( * ) Notice: Subject to any disclaimer, the term of this patent is extended or adjusted under 35 U.S.C. 154(b) by 166 days.

(21) Appl. No.: 14/047,374

(22) Filed: Oct. 7, 2013

(65) Prior Publication Data

US 2014/0106589 A1 Apr. 17, 2014

(30) Foreign Application Priority Data

Oct. 16, 2012 (IT) ..... TO2012A0905

(51) Int. Cl.

| | |
|---|---|
| ***H01R 13/40*** | (2006.01) |
| ***H01R 13/52*** | (2006.01) |
| ***H01R 43/16*** | (2006.01) |
| *H01R 13/436* | (2006.01) |

(52) U.S. Cl.

CPC ..... *H01R 13/5221* (2013.01); *H01R 13/5208* (2013.01); *H01R 43/16* (2013.01); *H01R 13/4362* (2013.01); *Y10T 29/49208* (2015.01)

(58) Field of Classification Search

CPC ..... H01R 3/5208; H01R 13/5221
USPC ..... 439/587–589, 595, 274, 148, 275, 936
See application file for complete search history.

(56) References Cited

U.S. PATENT DOCUMENTS

| | | | | |
|---|---|---|---|---|
| 4,993,964 | A * | 2/1991 | Trummer | 439/272 |
| 5,788,519 | A | 8/1998 | Stern | |
| 6,155,850 | A * | 12/2000 | Martin et al. | 439/157 |
| 6,200,164 | B1 * | 3/2001 | Martin et al. | 439/595 |
| 7,686,647 | B1 | 3/2010 | Hong | |
| 8,777,648 | B2 * | 7/2014 | Kitajima et al. | 439/271 |
| 2002/0002000 | A1 * | 1/2002 | Okamura et al. | 439/587 |
| 2008/0014794 | A1 | 1/2008 | Lutsch et al. | |

FOREIGN PATENT DOCUMENTS

| | | | |
|---|---|---|---|
| DE | 4015793 | A1 | 12/1990 |
| DE | 198 15 890 | | 10/1998 |
| EP | 1 879 263 | A1 | 1/2008 |
| GB | 2325356 | | 11/1998 |

* cited by examiner

*Primary Examiner* — Phuongchi T Nguyen
(74) *Attorney, Agent, or Firm* — Barley Snyder

(57) ABSTRACT

An electrical connector includes a connector body, the connector body having a plurality of seats for a plurality of terminal contacts. The electrical connector also includes at least one sealing element received in the connector body in a plane transverse to conductors associated with the plurality of terminal contacts, so as to provide a seal around the conductors. The connector body is provided with a guide passage for slidingly mounting a sealing layer within the connector body, by moving the sealing layer parallel to a plane thereof, in such a way that the sealing layer can be inserted into the connector body after the plurality of terminal contacts along with the respective conductors have been received in the connector body. The sealing layer engages slidingly around the conductors until a final mounting position is reached.

16 Claims, 9 Drawing Sheets

ELECTRICAL CONNECTOR COMPRISING A SEALING ELEMENT AND ASSEMBLY PROCESS

Figure 1:
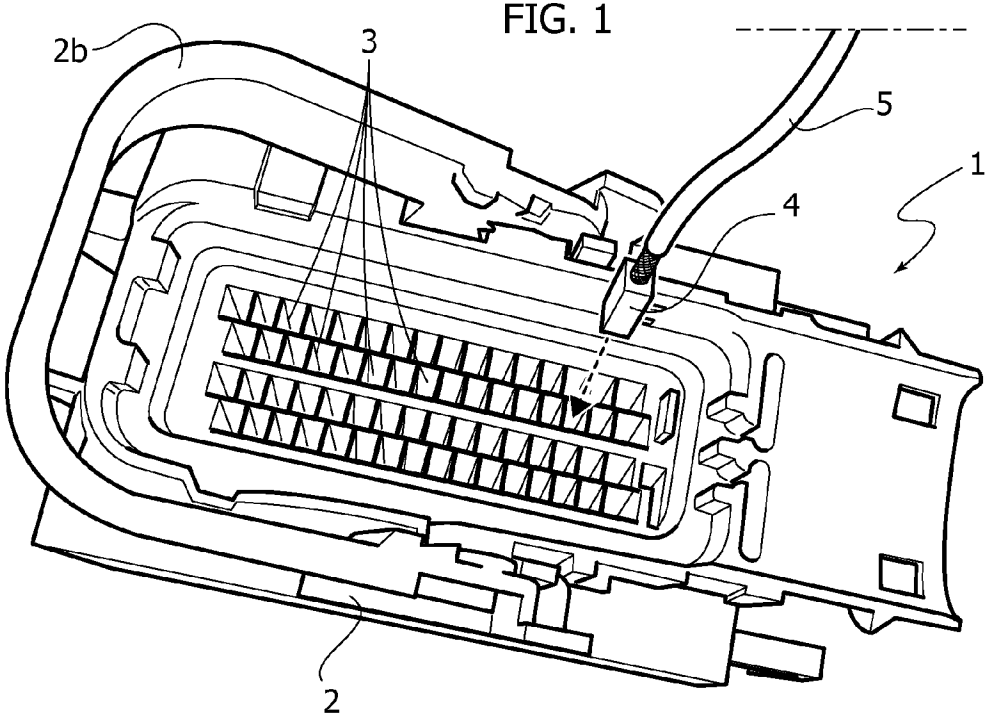
Figure 2:
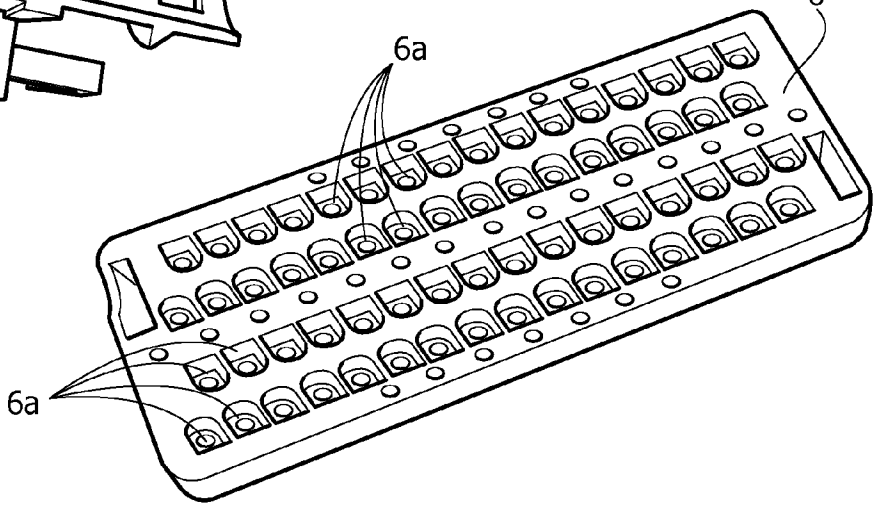
Figure 3:
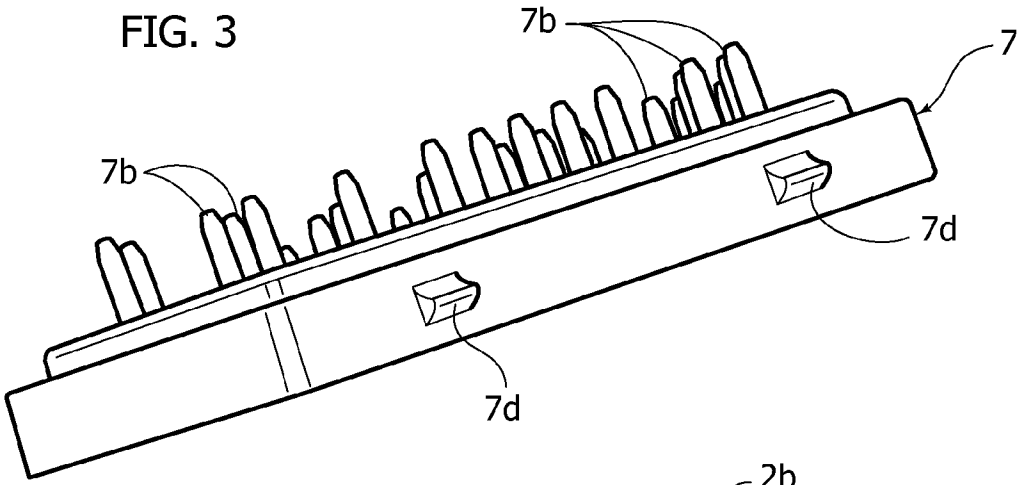

The present invention relates to an electrical connector comprising a connector body including a plurality of seats for a plurality of terminal contacts each associated with a respective conductor, and at least one sealing element in the form of a layer of resiliently deformable, electrically insulating material, received within the body of the connector in a plane transverse to the conductors associated with said terminal contacts, so as to provide a seal around the conductors.

Referring to FIGS. 1 to 4, which relate to the prior art, an electrical connector is denoted as a whole by reference numeral 1. The connector 1 comprises a connector body 2 which provides in the interior thereof, and on the base portion 2*a* thereof, a plurality of seats 3 which can each receive in the interior thereof a terminal contact 4 associated with a respective conductor 5.

The connector 1 further comprises a sealing element 6 (see FIG. 2) in the form of a layer of resiliently deformable, electrically insulating material. The sealing layer 6 is received within the body 2 of the connector 1 and similarly has a plurality of through-holes 6*a* for sealing engagement of the conductors 5 associated with said terminal contacts 4. Naturally, the through-holes 6*a* of the sealing layer 6 are arranged in such a way that, when it is assembled with the connector 1, they are positioned in a manner corresponding to the respective seats 3.

The connector 1 may further comprise a cover element 7 (see FIG. 3) which similarly has through-apertures 7*a* arranged in such a way that, when it is assembled with the connector 1, they are likewise positioned in a manner corresponding to the respective seats 3 and the through-holes 6*a*. The cover element 7 further provides plugs 7*b*, arranged in some of the apertures 7*a*, for closing the seats 3 which do not need to accommodate a respective terminal contact 4. The cover element 7 further comprises mounting feet 7*d* for guiding the positioning of the element inside the body 2 of the connector. The cover element 7 may thus be seen as a "map" which the technician uses for the wiring.

Figure 4:
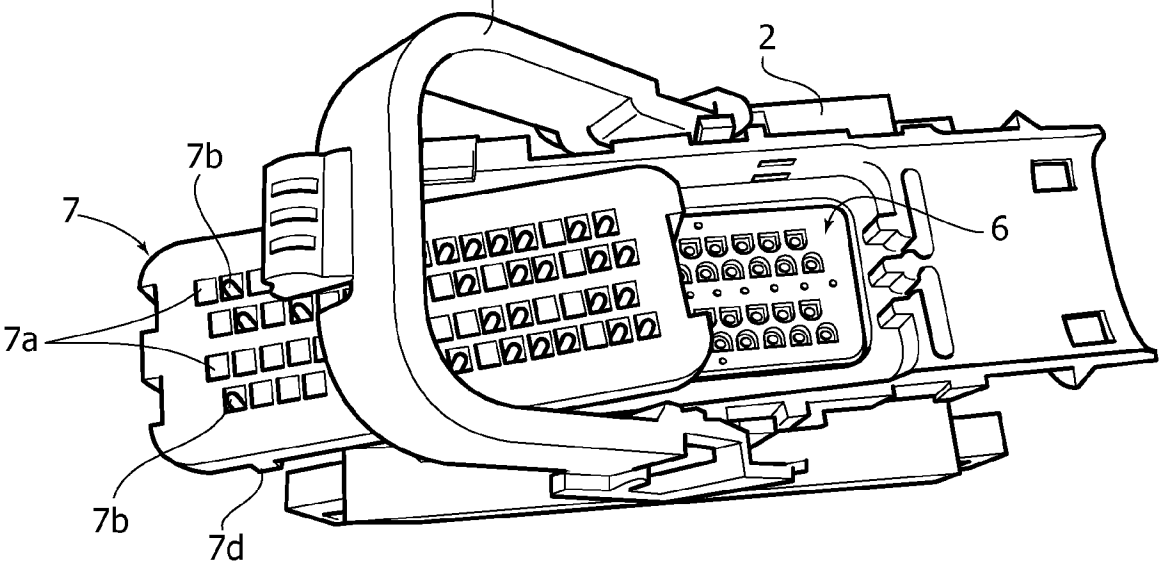

Referring to FIG. 4, it may be noted that the connector is assembled by positioning the sealing element 6 on the base portion 2*a* in such a way that the through-holes 6*a* are arranged above the respective seats 3. Subsequently, the cover element 7 is inserted by arranging it above the sealing element 6, and finally this is followed by the wiring operation of inserting the terminal contacts 4 into the through-apertures 7*a*, by passing them through the sealing layer 6, until the seats 3 are finally reached, the conductor 5 thus being inserted into the connector 1.

Finally, the body 2 of the connector 1 comprises a lever-operated locking element 2*b* which activates fixing bars 2*c* to engage and secure the connector 1 to a counter piece (not shown in the drawings). By displacing the lever 2*b* from an open position to a covering position, the connector is coupled to the counter piece.

The object of the present invention is to provide a sealed electrical connector of the type specified above, which is of a relatively simple and cheap construction, and which makes it possible to provide a sealing system with a small (or tending to zero) force for inserting the terminal through the sealing element.

A further object of the present invention is to provide an electrical connector which preserves all of the advantages of the known solution, and which makes it possible to provide different cycles of inserting/removing the contacts without compromising the simplicity of manufacture and the reliability of the sealing.

According to the present invention, this object is achieved by an electrical connector having the features stated above and further characterised in that the connector body is provided with a guide passage for slidingly mounting the sealing layer within the connector body, by moving the sealing layer parallel to the plane thereof in such a way that the sealing layer can be inserted into the connector body after said terminal contacts along with the respective conductors have been received in the connector body, and in such a way that the sealing layer engages slidingly around the conductors until a final mounting position is reached.

In the preferred embodiment, the sealing layer is provided with a plurality of through-holes defined by one or more continuous slits formed in said sealing layer from an end face of the sealing layer, in such a way that the sealing layer can be inserted into the connector body by using the end face of the sealing layer as a front face in the sliding movement, in such a way that the slits in the sealing layer engage slidingly around the conductors until the final mounting position is reached.

In a variant, the sealing layer is provided with one or more longitudinal portions of reduced thickness formed in said sealing layer from at least one end face of the sealing layer, in such a way that the sealing layer can be inserted into the connector body by using the end face of the sealing layer as the front face in the sliding movement, in such a way that the longitudinal portions of the sealing layer are cut off by the conductors and engage slidingly around the conductors until the final mounting position is reached.

In the aforementioned preferred embodiment, each continuous slit of the sealing layer has circular mutually equidistant apertures defining said through-holes, and each circular aperture is formed in the sealing layer and along the continuous slit so as to be aligned with a corresponding seat formed in the connector body when the sealing layer is mounted in the final position thereof.

Still referring to said preferred embodiment, the continuous slits extend from the front end face and are interrupted before reaching the rear end face of the sealing layer.

Preferably, a plastics material support body, suitable for rigidifying the sealing element and facilitating the operations for inserting the sealing element into the guide passage formed in the connector body, is associated with the sealing element. The support body of the sealing element is of a fork shape comprising a plurality of longitudinal arms which protrude in a projection from a grip portion. The arms are arranged so as not to interfere with the pre-assembled conductors in the connector during the insertion of the sealing element into the guide passage formed in the connector body.

In a preferred embodiment, the support body has fixing elements provided on the longitudinal arms thereof for fixing and holding in place the sealing layer on the support body.

Preferably, each of the two end arms of the support body has a plurality of radially protruding teeth. The teeth are suitable for engaging with a respective longitudinal guide groove formed in the guide passage formed in the connector body, so as to facilitate the sliding mounting of the sealing element fitted on the support body.

In one embodiment, the connector further comprises a cover element comprising a plurality of through-holes into which the conductors are inserted. The cover element is positioned above the body of the connector prior to the operation of inserting the terminal contacts, in such a way that the through-holes are positioned in a manner corresponding to the corresponding seats formed in the connector body. After the sliding insertion of the sealing element, to improve the sealing the cover element is brought from the raised rest position thereof into the lowered operational position thereof in which it compresses the sealing element.

Preferably, the sealing element is made of gel or silicone, and the material has self-adhering and self-healing properties such that, after the sealing element has been inserted into the connector body, the properties tend to bring together and close the slits and the circular apertures previously deformed by the sliding travel around the preassembled conductors in the connector.

The present invention further relates to a process for assembling an electrical connector of the type stated above, comprising the steps of:

providing, in the connector body, a guide passage for slidingly mounting the sealing layer inside the connector body by moving the sealing layer parallel to the plane thereof, inserting the terminal contacts along with the respective conductors into the seats formed in the body of the connector, and slidingly mounting the sealing layer in the body of the connector, causing the slits of the sealing layer to engage slidingly around the conductors until a final mounting position is reached, in such a way that the sealing layer can be inserted into the body of the connector after said terminal contacts, along with the respective conductors, have been received in the body of the connector, and in such a way that the sealing layer engages slidingly around them until a final mounting position is reached.

Preferably, the sealing layer is provided with a plurality of through-holes defined by one or more continuous slits formed in said sealing layer from an end face of the sealing layer, in such a way that the sealing layer can be inserted into the connector body by using the end face of the sealing layer as a front face in the sliding movement, in such a way that the slits in the sealing layer engage slidingly around the conductors until the final mounting position is reached.

Alternatively, the sealing layer is provided with one or more longitudinal portions of reduced thickness formed in said sealing layer from at least one end face of the sealing layer, in such a way that the sealing layer can be inserted into the connector body by using the end face of the sealing layer as the front face in the sliding movement, in such a way that the longitudinal portions of the sealing layer are cut off by the conductors and engage slidingly around the conductors until the final mounting position is reached.

Further, it is possible to provide the step of providing a cover element comprising a plurality of through-holes into which the conductors are inserted, the cover element being positioned above the body of the connector prior to the operation of inserting the terminal contacts, in such a way that the through-holes are positioned in a manner corresponding to the corresponding seats formed in the connector body, and that after the sliding insertion of the sealing element, to improve the sealing a step of activating the cover element is provided in which it is brought from the raised rest position thereof into the lowered operational position thereof in which it compresses the sealing element.

By virtue of the features stated above, on the one hand the connector according to the invention is made simple and cheap to produce, and on the other hand, it guarantees secure and reliable sealing. The formation thereof further makes it possible to prevent the terminal contacts of the conductors from being soiled by gel particles, since the gel sealing layer does not come into contact therewith, being mounted on the connector after the terminal contacts have already been assembled in the respective seats.

One of the advantages which can be achieved with a connector according to the invention is that it is no longer necessary to provide cover elements for insertion into the seats which are left free by the conductors, since the self-adhering features of the gel itself guarantee the sealing.

Figure 5:
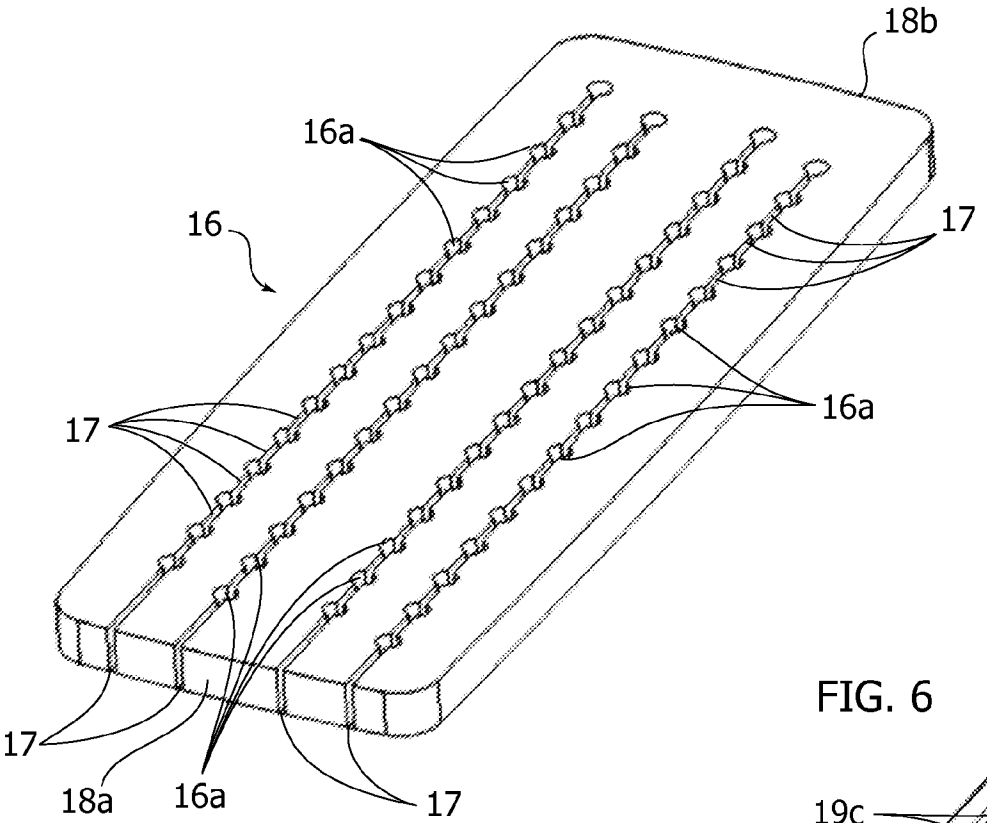
Figure 6:
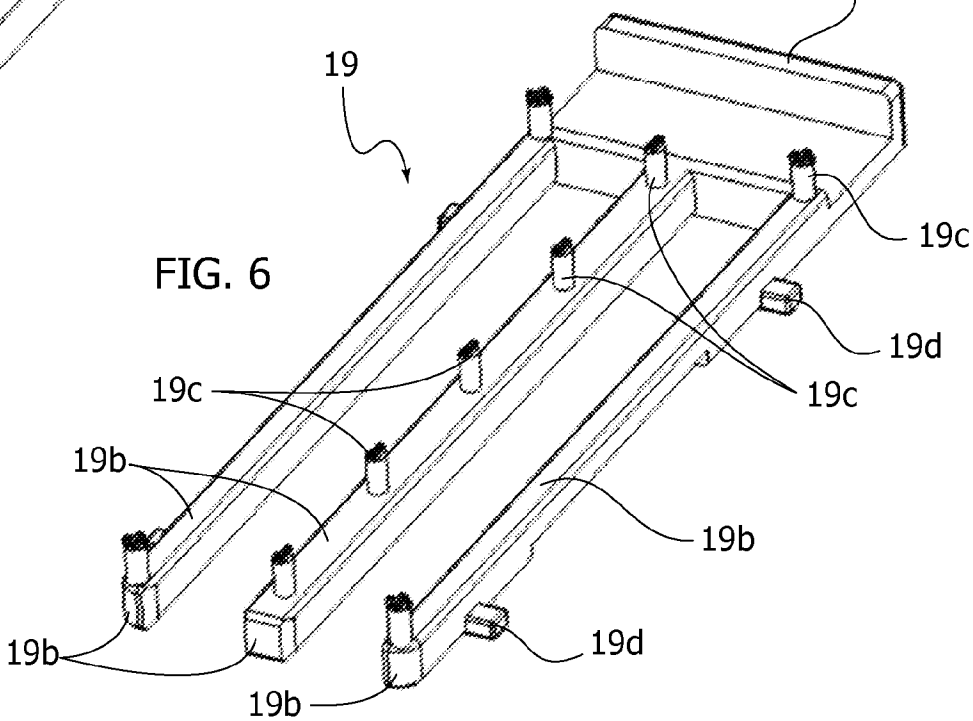
Figure 7:
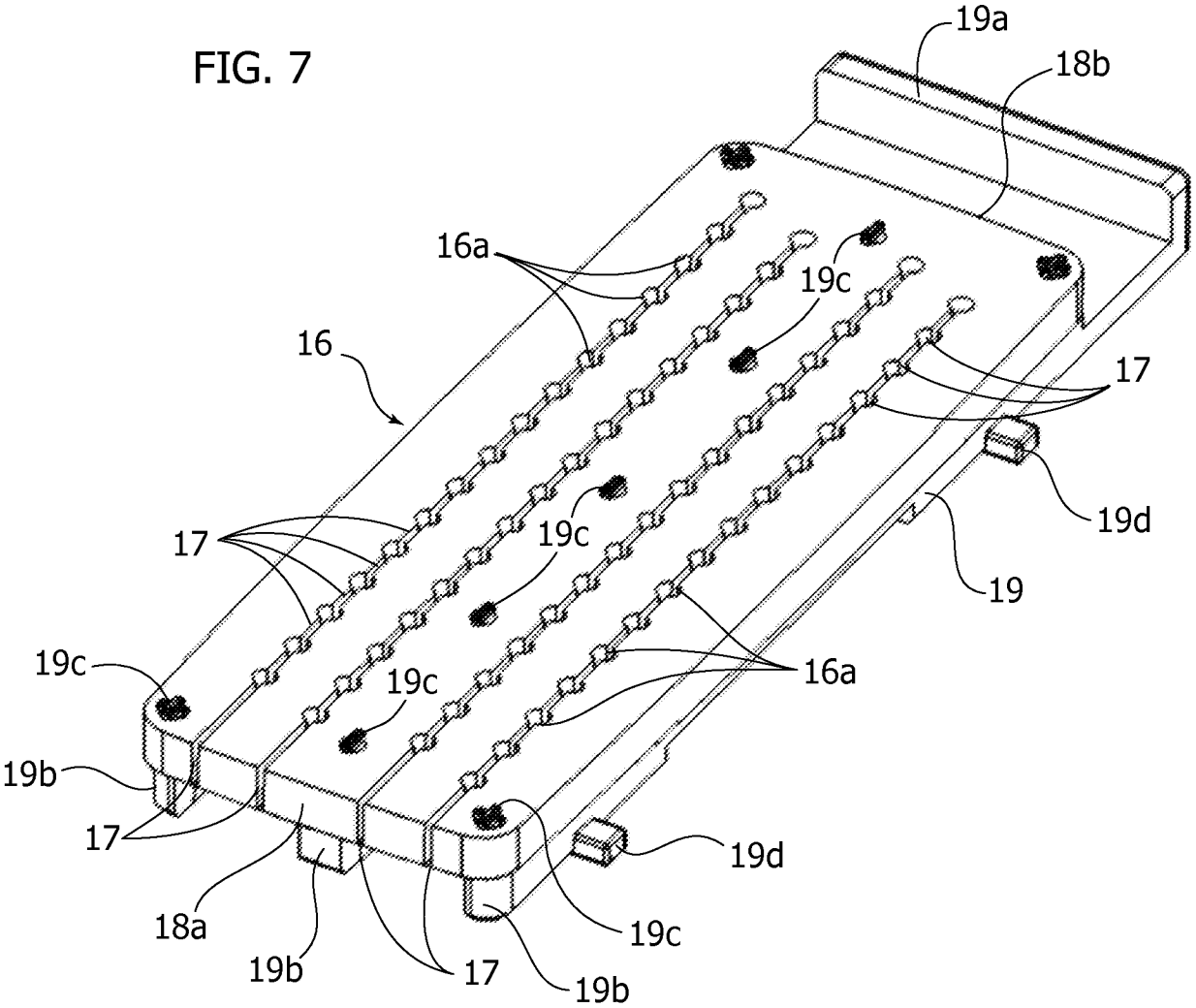
Figure 8:
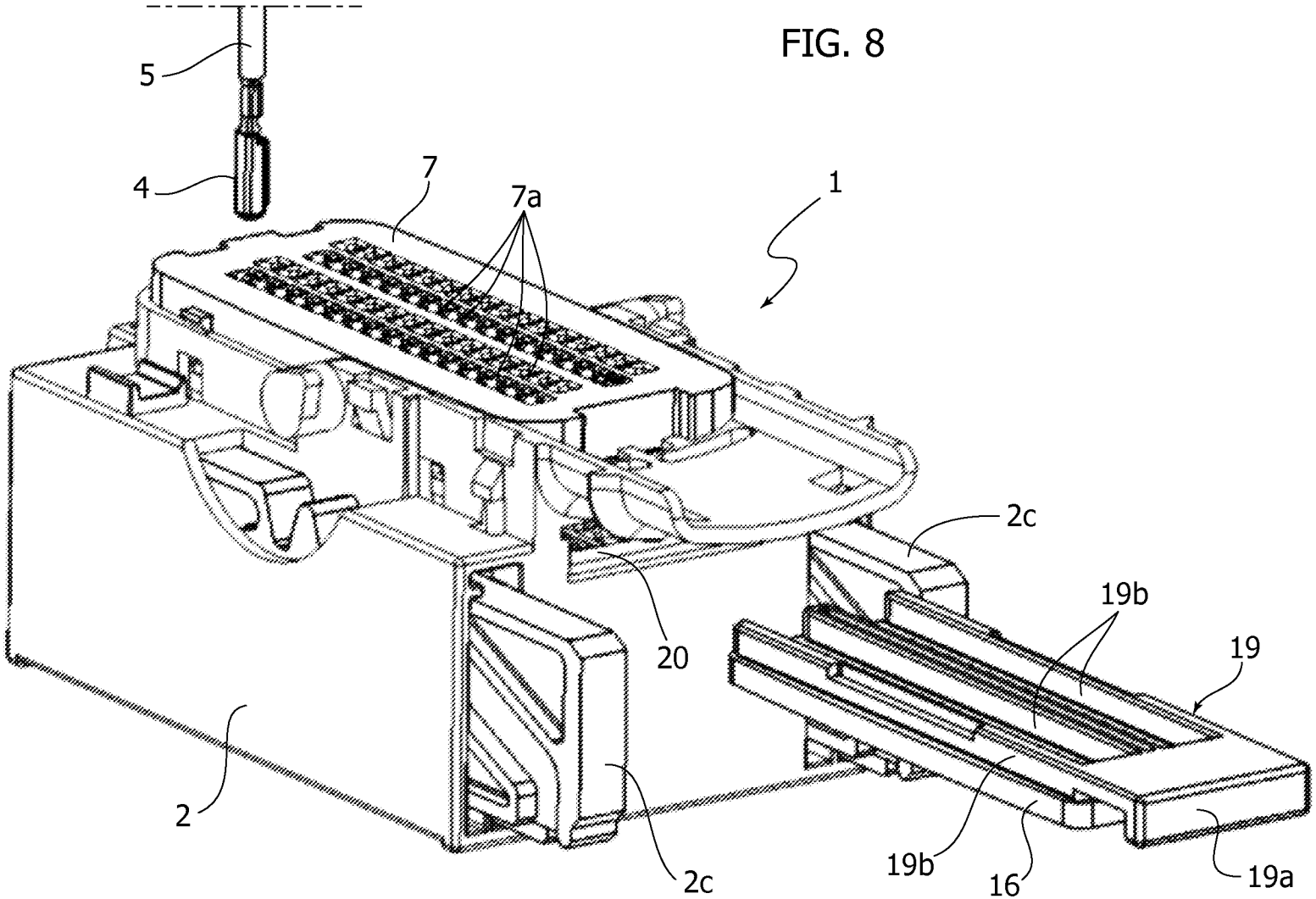
Figure 9:
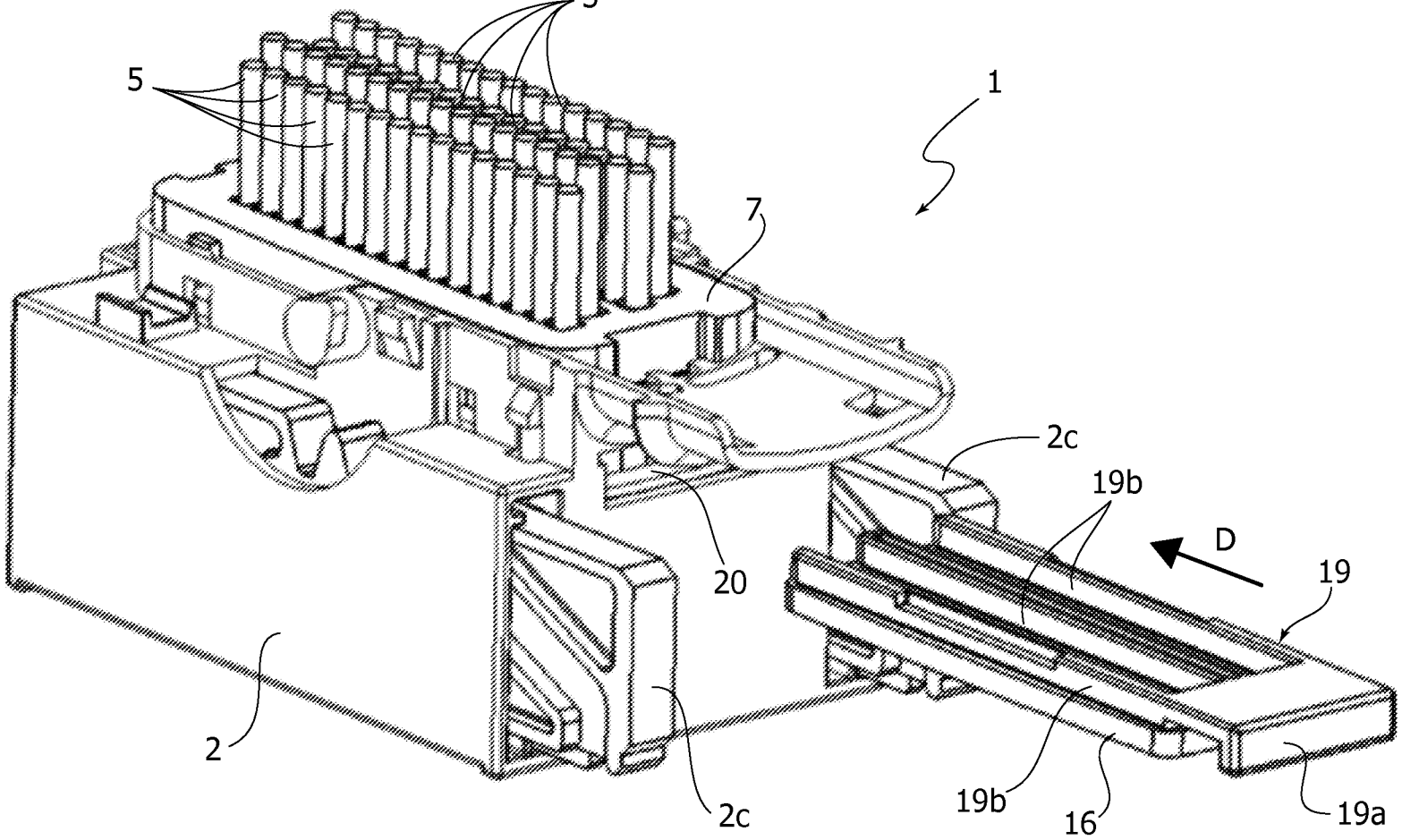
Figure 10:
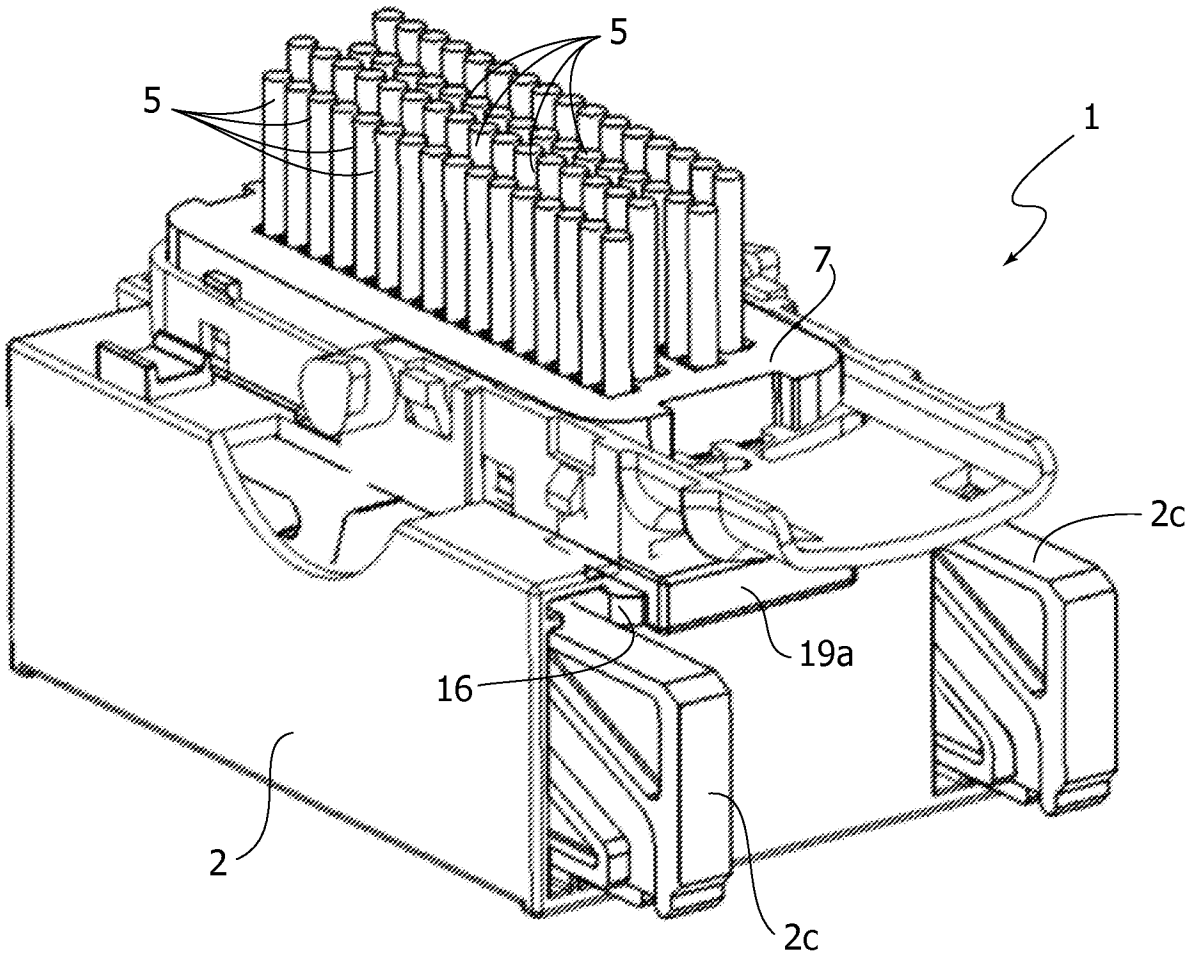
Figure 11:
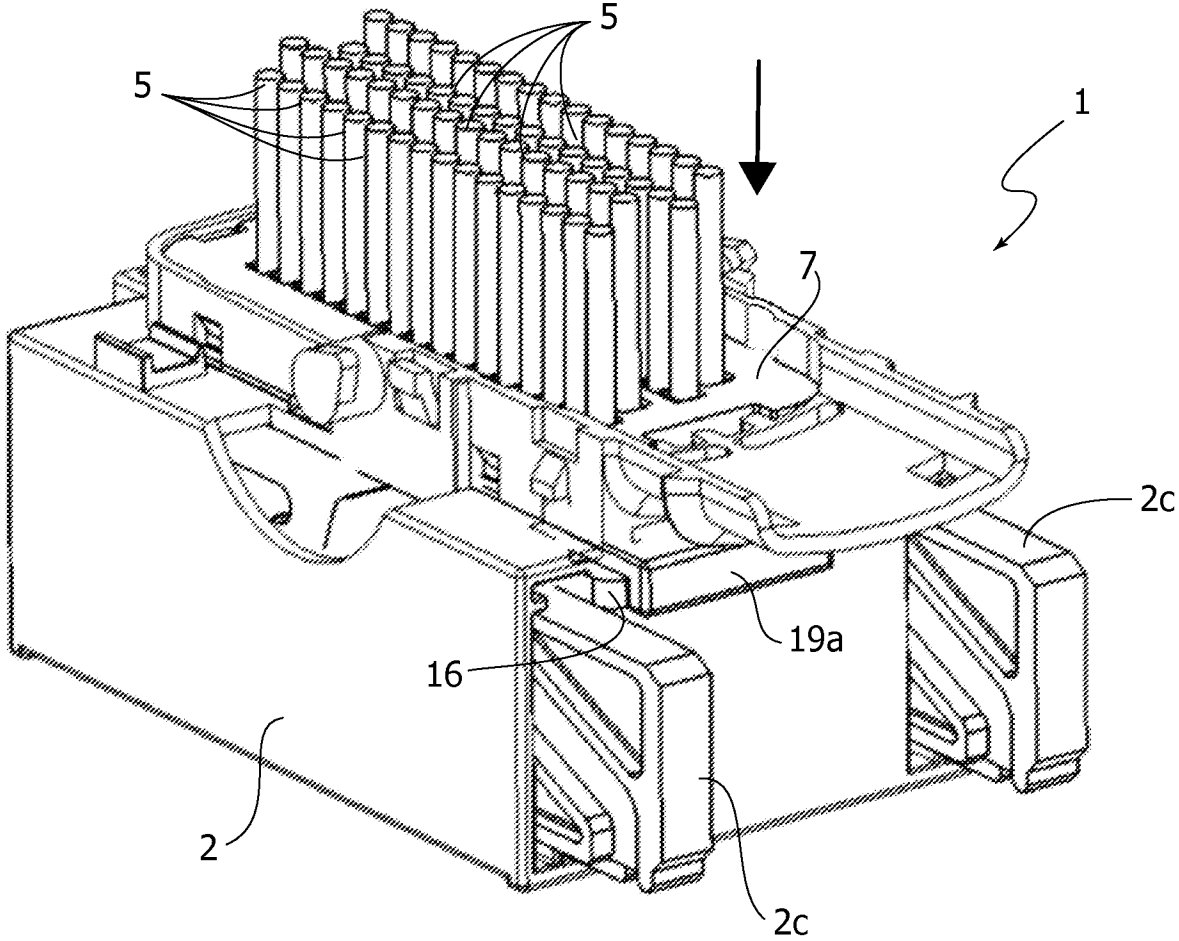
Figure 12:
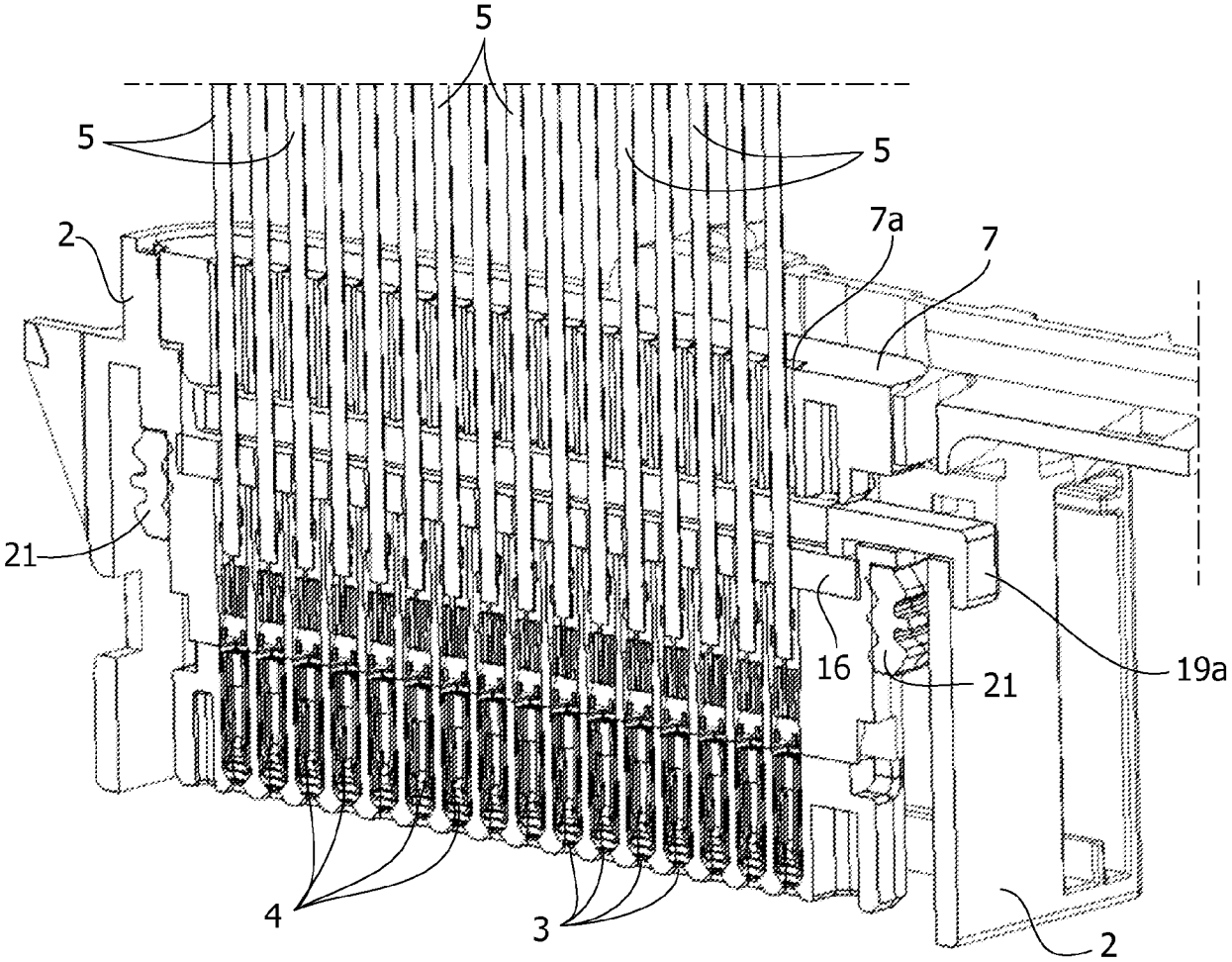

Further features and advantages of the invention may be taken from the following description with reference to the appended drawings, which are provided purely by way of non-limiting example and in which:

FIGS. 1 to 4, relating to the prior art, were described previously,

FIGS. 5 to 7 are perspective views of the sealing element and the support element according to the present invention when decoupled and when coupled, FIGS. 8 to 11 are perspective views of a connector according to the present invention, in various states of assembly, and FIG. 12 is a sectional view of the connector according to the present invention, corresponding to the state of assembly shown in FIG. 11.

The following description illustrates various specific details intended to provide a thorough understanding of the embodiments. The embodiments may be implemented without one or more of the specified details, or using other methods, components, materials etc. In other cases, known constructions, constructional details, materials and operations are not shown or described in detail, since they may be implemented in any known manner and also since, when taken in isolation, they are not within the scope of the present invention.

In FIGS. 5 to 12, the common parts which were described above with reference to the embodiment shown in FIG. 1-4 will be denoted by the same reference numerals in the following, whilst the added or modified parts will be given a different reference numeral.

FIGS. 5 to 7 show a novel version according to the present invention of the sealing element 16.

Referring to FIGS. 5 to 7, in the sealing element according to the present invention, the through-holes 6*a* are defined by four continuous slits 17 formed in said sealing layer 16 from a front end face 18*a*.

In particular, each continuous slit 17 of the sealing layer 16 has mutually equidistant circular apertures 16*a* which define said through-holes 6*a*. Each circular aperture 16*a* is formed on the holding layer 16 and along the continuous slit 17 so as to be aligned with a corresponding seat 3 formed in the body of the connector 1 when the sealing layer 16 is mounted in the final position thereof. In the embodiment shown in the drawings, the circular apertures 16*a* of two adjacent continuous slits 17 are mutually offset.

In the embodiment shown in the drawings, the continuous slits 17 extend from the front end face 18*a* and are interrupted before reaching the rear end face 18*b* of the sealing layer 16.

In a different embodiment, not shown in the drawings, the sealing layer 16 is provided with one or more longitudinal portions of reduced thickness formed in said sealing layer 16 from at least one end face of the sealing layer 16, in such a way that the sealing layer 16 can be inserted into the connector body 2 by using the end face of the sealing layer 16 as the front face in the sliding movement, in such a way that the longitudinal portions of the sealing layer 16 are cut off by the conductors 5 and engage slidingly around the conductors 5 until the final mounting position is reached.

The reduced thickness of the longitudinal portions with respect to the overall size of the sealing layer 16 makes it possible for the conductors 5 to cut the material easily, in such a way that the sealing layer 16 can slide easily on the conductors 5.

FIG. 6 shows a plastics material support body 19 suitable for rigidifying the sealing element 16. FIG. 7 shows the assembled state of the sealing element 16 and the bearing body 19. Aside from rigidifying the sealing element 16, the presence of the bearing body 19 facilitates the operations of inserting the sealing element 16 into the guide passage 20 (see FIG. 8) formed in the body 2 of the connector 1.

In the example of the embodiment shown in the drawings, the support body 19 is of a fork shape comprising three longitudinal arms 19*b* which protrude in a projection from a grip portion 19*a*. The three arms 19*b* are arranged so as not to interfere with the pre-assembled conductors 5 in the connector 1 during the insertion of the sealing element 16 into the guide passage 20 formed in the connector body 2.

In FIG. 6, fixing elements 19*c* in the form of pins can be seen on the support body 19, and are provided on the longitudinal arms 19*b* and suitable for fixing and holding in place the sealing layer 16 on the support body 19.

Further, each of the two end arms 19*b* of the support body 19 has two teeth 19*d*, protruding radially outwards from the end arms 19*b* and suitable for engaging with a respective longitudinal guide groove formed in the guide passage 20 formed in the body 2 of the connector 1, so as to facilitate the sliding mounting of the sealing element 16 fitted on the support body 19.

To mount the sealing layer 16 slidingly in the body 2 of the connector 1, the sliding layer 16 supported by the bearing body 19 is moved parallel to the plane thereof. The end face 18*a* of the sealing layer 16 is used as the front face in the sliding movement.

By virtue of the shaping of the sealing layer 16 and the bearing body 19, the sealing layer 16 can be inserted into the body 2 of the connector 1 after said terminal contacts 4 along with the respective conductors 5 have been received in the body 2 of the connector, causing the slits 17 of the sealing layer 16 or the portions of reduced thickness to engage slidingly around the conductors 5 until a final mounting position is reached.

The connector 1 further provides a cover element 7 comprising a plurality of through-holes 7*a* into which the conductors 5 are inserted. The cover element 7 is positioned above the body 2 of the connector prior to the operation of inserting the terminal contacts 4, in such a way that the through-holes 7*a* are positioned in a manner corresponding to the corresponding seats 3 formed in the body 2 of the connector 1. After the sliding insertion of the sealing element 16, to improve the sealing the cover element 7 is displaced from the raised rest position thereof into the lowered operational position thereof in which it compresses the sealing element 16.

FIGS. 8 to 11 show various steps of the operation of assembling the electrical connector 1. In particular, FIG. 8 relates to the step of wiring the conductors inside the body 2 of the connector. Each connector 5 is positioned in a manner corresponding to a through-aperture 7*a* and inserted into the body of the connector until it reaches the corresponding seat 3 formed in the base portion of the connector 1. FIG. 9 relates to the state at the end of the wiring operation, whilst FIG. 10 shows the connector 1 at the end of the operation of slidingly inserting the sealing layer 16 borne by the support body 19. Finally, FIG. 11 shows the connector 1 at the end of the assembly operations, in which the cover element 7 has been brought into the lowered operative position thereof (in the direction shown by the arrow) in which it compresses the sealing element 16.

The sealing element 16 is made of gel or silicone (for example the gel marketed as GT-4201-T3.0-SHEET and produced by DOW CORNING).

The gel has self-adhering and self-healing properties such that, after the sealing element 16 has been inserted into the body 2 of the connector 1, said properties tend to bring together and close the slits 17 and the circular apertures 16*a* previously deformed by the sliding travel around the preassembled conductors 5 in the connector 1.

In the embodiment shown, the cover element 7 no longer requires the presence of the plugs 7*b*, since the self-adhering and self-healing properties ensure the closure of the circular apertures 16*a* which are not engaged by a respective conductor 5. Further, the compression of the sealing element 16 brought about by the cover element 7 promotes the closure of the slits 17, ensuring the sealing.

In FIG. 12, a radial sealing gasket 21 can further be seen, provided in the body 2 of the connector 1 so as to guarantee the sealing between the two counter pieces.

The present invention further relates to a process for assembling an electrical connector of the type stated previously, the process providing the steps of:

- providing, in the connector body 2, a guide passage 20 for slidingly mounting the sealing layer 16 inside the connector body 2, by moving the sealing layer 16 parallel to the plane thereof,
- inserting the terminal contacts 4 along with the respective conductors 5 into the seats 3 formed in the body 2 of the connector, and
- slidingly mounting the sealing layer 16 in the body of the connector, causing the slits 17 of the sealing layer 16 to engage slidingly around the conductors 5 until a final mounting position is reached, in such a way that the sealing layer 16 can be inserted into the connector body 2 after said terminal contacts 4 along with the respective conductors 5 have been received in the body 2 of the connector, and in such a way that the sealing layer 16 engages slidingly around the conductors 5 until a final mounting position is reached.

The sealing element is inserted into the connector after the wiring step, resulting in the wiring operation itself being facilitated even for conductors having a diameter of reduced dimensions. Further, different cycles of inserting/removing the conductors can be implemented without reducing the sealing performance of the sealing layer, which may be removed from the connector previously before carrying out the new operations of inserting/removing the conductors. Finally, with the connector according to the present invention, the terminal contacts of the conductors are prevented from being "soiled" by free gel particles, since the sealing layer only comes into contact with the part of the conductor covered by the protective sheath, and not with the contact terminals.

Of course, without prejudice to the principle behind the invention, the construction details and the embodiments can be varied considerably from what has been described and illustrated purely by way of example, without going beyond the scope of the invention as a result of this.

LIST OF PARTS

1: electrical connector
2: connector body
2*a*: on the base portion
2*b*: lever-operated locking element
2*c*: fixing bars
3: seats for receiving the terminal contacts

4: terminal contacts
5: conductors
6: sealing element
6*a*: through-holes
7: cover element
7*a*: through-holes
7*b*: plugs
7*d*: mounting feet
16: sealing layer or element
16*a*: circular aperture
17: continuous slit
18*a*: front end face
18*b*: rear end face
19: support body
19*a*: grip portion
19*b*: longitudinal arms
19*c*: fixing elements
19*d*: protruding teeth
20: guide passage
21: radial sealing gasket

The invention claimed is:

1. An electrical connector comprising:

a connector body including a plurality of seats for a plurality of terminal contacts each terminal contact of the plurality of terminal contacts associated with a respective conductor; and at least one sealing element in the form of a layer of resiliently deformable, electrically insulating material, received in the connector body in a plane transverse to the conductors associated with the plurality of terminal contacts, so as to provide a seal around said conductors;

wherein the connector body is provided with a guide passage for slidingly mounting a sealing layer within the connector body, by moving the sealing layer parallel to a plane thereof, in such a way that the sealing layer can be inserted into the connector body after the plurality of terminal contacts along with the respective conductors have been received in the connector body; and wherein the sealing layer engages slidingly around said conductors until a final mounting position is reached.

2. The electrical connector according to claim 1, the sealing layer is provided with one or more longitudinal portions of reduced thickness formed in the sealing layer from at least one end face of said sealing layer; and wherein the sealing layer can be inserted into the connector body by using the at least one end face of the sealing layer as the front face in a sliding movement, in such a way that the one or more longitudinal portions of the sealing layer are cut off by the conductors and engage slidingly around the conductors until the final mounting position is reached.

3. The electrical connector according to claim 1, comprising a cover element comprising a plurality of through-holes into which the conductors are inserted, the cover element being positioned above the connector body prior to inserting the plurality of terminal contacts, in such a way that the plurality of through-holes are positioned in a manner corresponding to the plurality of seats formed in the connector body, and in that after sliding insertion of the sealing element, to improve the sealing the cover element is displaced from a raised rest position thereof into a lowered operational position thereof in which the cover element compresses the sealing element.

4. The electrical connector according to claim 1, wherein the sealing element is made of gel or silicone.

5. The electrical connector according to claim 4, wherein the gel has self-adhering and self-healing properties such that, after the sealing element has been inserted into the connector body, the self-adhering and self-healing properties bring together and close the one or more continuous slits and the circular apertures or the one or more longitudinal portions of reduced thickness previously deformed by the sliding travel around the preassembled conductors.

6. The electrical connector according to claim 1, wherein the sealing layer is provided with a plurality of through-holes defined by one or more continuous slits formed in the sealing layer from an end face of the sealing layer; and wherein the sealing layer can be inserted into the connector body by using said end face of the sealing layer as a front face in a sliding movement, in such a way that the one or more continuous slits in the sealing layer engage slidingly around said conductors until the final mounting position is reached.

7. The electrical connector according to claim 6, wherein each continuous slit of the sealing layer has circular mutually equidistant apertures defining the through-holes, and in that each aperture of the circular mutually equidistant apertures is formed in the sealing layer and along the one or more continuous slits so as to be positioned in a manner corresponding to a seat formed in the connector body when the sealing layer is mounted in the final mounting position.

8. The electrical connector according to claim 6 wherein the one or more continuous slits extend from the front end face and are interrupted before reaching the rear end face of the sealing layer.

9. The electrical connector according to claim 1, wherein a plastics material support body, suitable for rigidifying the sealing element and facilitating operations for inserting the sealing element into the guide passage formed in the connector body, is associated with the sealing element.

10. The electrical connector according to claim 9, wherein the support body is of a fork shape comprising a plurality of longitudinal arms which longitudinal arms protrude in a projection from a grip portion, the plurality of longitudinal arms being arranged so as not to interfere with the conductors (5) during insertion of the sealing element into the guide passage formed in the connector body.

11. The electrical connector according to claim 10, wherein the support body has fixing elements provided on the plurality of longitudinal arms thereof, the fixing elements being suitable for fixing and holding in place the sealing layer on the support body.

12. The electrical connector according to claim 10, wherein two end arms of the plurality of longitudinal arms have a plurality of radially protruding teeth, said radially protruding teeth being suitable for engaging with a respective longitudinal guide groove formed in the guide passage formed in the connector body, so as to facilitate the sliding mounting of the sealing element fitted on the support body.

13. A process for assembling an electrical connector, in which said electrical connector comprises a connector body including a plurality of seats for a plurality of terminal contacts each terminal contact of the plurality of terminal contacts associated with a respective conductor, and at least one sealing element in the form of a layer of resiliently deformable, electrically insulating material, received in the connector body in a plane transverse to the respective conductors associated with the plurality of terminal contacts so as to provide a seal around the conductors, the process comprising:

providing, in the connector body, a guide passage for slidingly mounting the sealing layer inside the connector body, by moving the sealing layer parallel to the plane thereof;

inserting the plurality of terminal contacts along with the respective conductors into the plurality of seats formed in the connector body;

slidingly mounting the sealing layer in the connector body;

wherein the sealing layer can be inserted into the connector body after the plurality terminal contacts along with the respective conductors have been received in the connector; and wherein the sealing layer engages slidingly around the respective conductors until a final mounting position is reached.

14. The process according to claim 13, wherein the sealing layer is provided with a plurality of through-holes defined by one or more continuous slits formed in the sealing layer from an end face of the sealing layer; and wherein the sealing layer can be inserted into the connector body by using the end face of the sealing layer as a front face in a sliding movement, in such a way that the one or more continuous slits in the sealing layer engage slidingly around the respective conductors until the final mounting position is reached.

15. The process according to claim 13, wherein the sealing layer is provided with one or more longitudinal portions of reduced thickness formed in said sealing layer from at least one end face of the sealing layer; and wherein the sealing layer can be inserted into the connector body by using said at least one end face of the sealing layer as the front face in a sliding movement, in such a way that the one or more longitudinal portions of the sealing layer are cut off by the respective conductors and engage slidingly around the respective conductors until the final mounting position is reached.

16. The process according to claim 13, comprising providing a cover element comprising a plurality of through-holes into which through-holes the respective conductors are inserted, the cover element being positioned above the connector body prior to inserting the plurality of terminal contacts, in such a way that the plurality of through-holes are positioned in a manner corresponding to the plurality of seats formed in the connector body; and wherein after the slidingly mounting the sealing element activating the cover element, in which activating the cover element is brought from a raised rest position thereof into a lowered operational position thereof in which it the cover element compresses the sealing element.

* * * * *